United States Patent [19]

Hartmann

[11] Patent Number: 4,578,134

[45] Date of Patent: Mar. 25, 1986

[54] PROCESS FOR THE PRODUCTION OF SPUNBONDED FABRICS FROM AERODYNAMICALLY DRAWN FILAMENTS

[76] Inventor: Ludwig Hartmann, Pascalstr. 3, 6750 Kaiserslautern, Fed. Rep. of Germany

[21] Appl. No.: 627,198

[22] Filed: Jul. 2, 1984

[30] Foreign Application Priority Data

Dec. 1, 1984 [DE] Fed. Rep. of Germany ..... 3400847

[51] Int. Cl.[4] ..... D04H 3/16

[52] U.S. Cl. ..... 156/167; 264/176 F; 264/210.8

[58] Field of Search ..... 156/167, 181, 441, 229; 264/176 F, 210.8, 280.5, 37; 425/725

[56] References Cited

U.S. PATENT DOCUMENTS 3,991,250 11/1976 Hartman et al. ..... 156/167

FOREIGN PATENT DOCUMENTS 2340486 2/1974 Fed. Rep. of Germany ..... 156/622

*Primary Examiner*—Michael Ball

*Attorney, Agent, or Firm*—Keil & Weinkauf

[57] ABSTRACT

A process for the production of spunbonded webs by the aerodynamic drawing of filaments or filament rows which are drawn by means of air currents divided into component currents whereby the air current is divided into a conditioning current and a drawing current for the conduction and the drawing of the filaments or filament rows, and into a deposition zone current for the fixation of the web, which is deposited in random texture, in its transportation on the perforated collecting screen, and the deposition zone current being sucked off, together with the spinning space current, in a plurality of zones and being returned to the spinning room as a holding current. An additional spinning room current for balancing out the overall system is introduced into the spinning room. The conditioning current and the drawing current are introduced in solely added air mode and the depositing current and holding current are, respectively, within and without in mostly circulated air mode.

9 Claims, 2 Drawing Figures

PROCESS FOR THE PRODUCTION OF SPUNBONDED FABRICS FROM AERODYNAMICALLY DRAWN FILAMENTS

FIELD OF THE INVENTION

The invention relates to a process for the production of spunbonded fabrics by aerodynamically drawing filaments or filament rovings with the aid of air currents divided into component currents and supplied to a perforated collecting screen where they are deposited in random texture, are held in this position by air suction and supplied to a solidification aggregate.

BACKGROUND OT THE INVENTION AND PRIOR ART

Spunbonded fabrics are known and they are produced from mechanically or aerodynamically drawn-off and stretched or drawn filaments or filament strands which are deposited in random texture on a conveyor belt and in this form are supplied to a bonding aggregate. In the prior art production of spunbonded fabrics with aerodynamic drawing of the filaments or filament strands and their deposition, drawing air currents are used. The energy consumption is very high because in order to avoid spinning dust deposits it is necessary to operate substantially with fresh air. Particularly in the spinning of polypropylenes and polyamides the aerosols produced at the spinning nozzle due to depolymerization of the spinning polymers tend to be precipitated in and on the drawing-off elements and to disturb the spinning as well as the web formation process. For this reason it is inadvisable to supply the air currents with recirculated air. The high energy consumption in the case of employment of fresh air must be put up with. As the air currents impinge on the perforated conveyor belt turbulence can easily be produced during the formation of the web and this turbulence adversely affects or prevents the uniformity of the filament deposition and thus of the web formation. Here, too, the spinning dust which in the spinning process is produced by the depolymerization of the polymers is troublesome inasmuch as it precipitates on the collecting screen and impairs the air permeability of the same because the filaments deposited on the web are insufficiently held down and do not come to rest in the desired optimal structure.

The high number of filaments which are spun in a large commercial plant is in most cases above 6,000 so that considerable problems arise in regard to air conduction, for the high number of filaments must be uniformly guided, conditioned, drawn and laid down. In the very large deposit area of the surfaces of 4 to 6 m width a uniform surface structure of the filament deposit must be insured. This uniform structure must be maintained, upon deposition without distortions of the web until the transfer of the still loose web to the bonding aggregate. It is known that the uniformity of the spinning webs formed of such a high number of filaments can be improved if the filaments are spun from so-called longitudinal spinning nozzles. Longitudinal spinning nozzles contain straight rows of spinning apertures and make the spinning of linear filament rovings possible. In the aerodynamic drawing of the relatively loosely guided filaments, however, the danger of entanglements arises, here too, whereby, again in the conveying-off of the freshly formed, still loosely intertwisted filaments from the range of the web formation to the zone of solidification of the web, measures must be taken to avoid air current turbulence. Such turbulence, as is well known, reduces the quality of the web structure. Also abrupt transitions of the air currents must be prevented because in this way the web becomes distorted.

In the aerodynamic drawing of filaments the elimination of spinning dust gives rise to great difficulties because the relatively loosely guided filaments, in being subjected to air blown in the drawing-off direction become easily entangled. In the case of filaments which are mechanically drawn off the spinning nozzles and drawn this danger is less pronounced since in this manner they are held under a predetermined tension between nozzle and drawing-off element so that it is possible to subject the filaments to relatively high air currents transversely of the drawing-off direction and thus to eliminate the aerosols and simultaneously cool the filaments. Mechanical drawing-off methods however are less economical compared with aerodynamic drawing methods, particularly in regard to speed of production so that in the case of modern large plants aerodynamic drawing of the filaments is preferred. In this connection it is also customary to conduct the air currents as component currents in such a manner that the drawing off of the filaments is carried out with the aid of the conditioning current and the filaments are then conducted to the perforated collecting screen serving for the deposition of the web, with a separate drawing current.

OBJECTS AND SUMMARY OF THE INVENTION

The object underlying the invention is, first of all to lower the energy consumption in such an aerodynamic spinning process. Furthermore, underlying the invention is the object to render the deposition of the web more uniform and in particular to prevent the entanglement of the filaments by the drawing current. The enhanced uniformity of the filament deposition is to be maintained all the way to the condition of bonding the web at the end of the holding zone. Thus, here too air current turbulence which causes displacements of the filaments that have been freshly formed and have not yet been fixed in position, is to be prevented. Such turbulence would result in a reduction of the quality ot the web structure. Moreover, the process should be conducted so that abrupt transitions of the air currents are obviated since also in this manner the web may be distorted.

The object according to the invention is met, briefly, by a process of the kind set forth at the beginning of the specification, wherein the air current is divided into a conditioning current and a drawing current for the conduction and the drawing of the filaments or filament rovings and into a deposition zone current for the fixation of the web, which has been deposited in random texture, in its transportation on the perforated collecting screen, the deposition zone current being sucked off through the collecting screen together with the spinning room air in a plurality of zones and being reintroduced into the spinning room as a holding current, and an additional spinning room current being introduced into the spinning room for balancing out the overall system, the conditioning current as well as the drawing current being introduced in solely added air mode and the depositing current and the holding current being withdrawn and introduced, respectively, in mostly recirculated mode, and wherein the spinning room current is supplied in mixed recirculated air/added air mode or in solely added air mode and the air velocities, as the filaments are being sucked off the spinning and deposition zone on the collecting screen, are lowered in the running direction, whereby, by means of the aforementioned air conduction of the component currents, the concentration of suspended particles is reduced in the opposite direction.

The process distinguishes itself by a considerable saving in energy since the air currents required for the drawing and for the laying down of the web which currents are sucked off underneath the collecting screen and transport belt, are, in part, carried back. Also, the spinning room current provided for the balancing out of the pressure is partially supplied by circulated air, if desired. The energy-expensive fresh air supply is limited to predetermined component currents.

It is necessary that the aforementioned air conduction be maintained. For example, if the operation is carried out merely with recirculated air, an increasing contamination and therefore disturbance of the spinning and the filament deposition conditions results, due to the enrichment of the recirculated currents with spinning dust. In particular, in the spinning of polypropylenes and polyamides, the aerosols resulting from the depolymerization of the spinning polymers tend to precipitate in and on the drawing-off elements and to disturb the spinning process as well as the web formation. Through the process flow proposed according to the invention it is possible therefore to lower these deposits to a minimum or to eliminate them completely. It is essential that the air currents required for the optimization of the filament and web properties be divided into component currents which, as to quantity, temperature and moisture, are targeted onto the required points in order to provide optimal process conditions. The result is an unusually uniform web structure.

The process makes it possible to let the relatively loosely guided filaments, in the drawing direction be impinged upon by a blowing stream in such a manner that no entanglement is produced and that the desired cooling and conditioning is obtained whereby the precipitation of the spinning dust in the drawing-off elements is safely avoided. At the locations in which the filaments are already in place and are maintained in place by corresponding suction, i.e., in the transport zone of the web, higher aerosol quantities may be present, that is at these locations recirculated air is used whereby the energy consumption is considerably reduced. The air currents which impinge in the transport zone and which, because of the recirculated air, are loaded with higher proportions of spinning dust—which air currents traverse the web prior to bonding—give rise to a separation of the suspended particles without however adversely affecting the web structure, if the suspended particles or spinning dust particles separated in the transport zone preferably on the collecting screen are removed before they are fed back in recirculation to the filament depositing and web forming zone. Preferably this takes place by cleaning the screen with a fluid current, preferably under higher temperatures, shortly prior to the turn around of the collecting screen in front of the web formation zone.

This step is necessary particularly when larger quantities of spinning dust are produced. For if the cleaning is omitted in this case then the porosity of the collecting screen decreases continuously and the laying down of the filaments to a web is disturbed. In permanent operation the uniformity of the web can then not be maintained. In order to avoid this it would be necessary to utilize cleaned air currents also in the transport zone such as in conventional technology, thereby resulting in considerably higher energy consumption.

The process is suited for the production of aerodynamically drawn spinning webs particularly in the case of materials which require high filament drawing-off velocities. This applies for example to the spinning of polyethylene terephtalates. In this case drawing-off velocities of more than 5,000 m/min are required when lower residual shrinkage values of the filaments are desired. In the case of a desired boiling shrinkage (KS) of less than 4% the following values of filament drawing-off velocities (VF) for different titres (Td) and maximum tensile elongations (y) as well as tensile strengths (Δ) have been found:

| VF m/min | KS % | Td dtex | N/dtex | % |
|---|---|---|---|---|
| 5043 | 4 | 5.6 | 3.05 | 112 |
| 5140 | 2 | 6.9 | 3.07 | 98 |
| 5364 | 3 | 8.4 | 3.04 | 98 |
| 5608 | 1 | 12.6 | 3.40 | 83 |

Such high filament drawing-off velocities can be obtained more easily if aerodynamic drawing-off elements are used than in the case of mechanical drawing off. The energy efficiency, it is true, drops with increasing velocity and with the force to be transmitted. The high air velocities of, for example 13,000 m/min in the case of filament drawing-off velocities of 5,000 m/min, in the case of known aerodynamic drawing processes, thus produce a high quality of the filaments but also a high consumption of energy and, due to the increase in turbulence, a reduction in the quality of the web structure. By virtue of the proposed process considerable improvement may be obtained with respect to the consumption of energy, the contamination of the air, as well as in regard to the quality of the web structure.

The polyamide spinning webs, especially in the spinning of polycaprolactam (nylon 6), a further phenomenon arises in addition to the aforementioned difficulties. Here too the physical structure of the filaments is of decisive significance for the properties. Due to depolymerization suspended particles (spinning dust) are produced, particularly in the form of caprolactam or dimeres. In this manner, in the case of the conventional processes, problems in regard to deposits on the air conducting systems are produced, in addition to the known difficulties. The turbulence leads to a reduction of the quality of the web structure.

The physical structure is determined in the case of nylon 6, by the molecular orientation, the degree of crystallinity and the crystal structure produced in aerodynamic drawing. It has been found that in the proposed process particularly favorable properties are obtained if a gamma crystalline structure is obtained. For this purpose drawing-off velocities of 3,000 m/min are maintained. Moisture in a quantity of 12 g/m$^3$ is added to the drawing-off air currents. This is desirable because polyamide, in 65% relative moisture, absorbs a water content of 5%.

Following the laying down, in the conveying-off zone of the perforated collecting screen, of the polyamide filaments to form the web, further moist air currents, so-called secondary or spinning space air, which have a temperature of 45° C. and a moistness of 8 g/m$^3$, must be supplied for the further conditioning of the filaments (crimping). Since the so-called holding or transport zone in the case of polyamide brings about a conditioning (crimping) and moisture absorption of the polyamide filaments prior to the bonding of the web, the employed recirculated air current masses represent, here too, a substatial energy consumption factor, whereby, again the air currents on the one hand are required for the drawing, laying down and conditioning but on the other hand also are disturbing from the standpoint of the attainment of good web structures. By means of the addition of moisture or steam quantities further energy problems are present which however are solved in the case of the proposed process.

In the conventional production of aerodynamically drawn polypropylene spunbonded webs with particularly high production velocities also considerable problems arise. These problems lie in the depolymerization and the suspended particles produced thereby, as in the formation of especially smooth filaments which, directly subsequent to the formation of the web, are subject to entanglement by turbulence in the web formation zone and then in the web transport zone. Especially in the transport zone drag air phenomena arise in the range of the rapidly running collecting screen which cause particular difficulties and, again, have to be eliminated in order to enhance the quality of the web. Here too the process according to the invention leads to an optimal web structure. A filament drawing-off velocity which has 10 to 20 times the value of the web running velocity has been found suitable so that in the web formation zone a certain accumulation of the very smooth filaments takes place. In the case of polypropylene spunbonded webs a strong formation of spinning dust occurs. This formation is caused by the decomposition of the melted polypropylene and precipitates in the air conducting elements and on the collecting screen. In the conventional process therefore the formation of uniform webs is adversely affected.

In the proposed process the known problems are solved through the introduction of several recuperative component air current systems which are provided with twist throttles and with varying speed drives and are connected with heat recovery systems. The rapid air currents necessary for high drawing ratios of the filaments are kept separately maintaining high degrees of purity in regard to the suspended particles (spinning dust). High tensile strengths of filaments are thereby obtained because of uniform filament guidance. The low-velocity air currents used in the transport or conditioning range are supplied separately from the aforementioned currents, whereby high web strengths are obtained at a low variation coefficient: A displacement of the filaments subsequent to their laying down is prevented since due to the prevention of turbulence which arises also owing to suspended particle deposits on the filament conducting elements an improved movement of the filaments is obtained.

In aerodynamic spinning, air velocities of 200–250 m/sec are present in the drawing-off channel. Simultaneously high electrostatic charges are produced which must be reduced through moistening of the drawing air. By virtue of the proposed conduction and treatment of the component air currents, different air currents can be differently adjusted. The different drawing-off velocities and degrees of moisture in the laying down of the filaments or the formation of the web on the one hand and the web transport zone (holding zone) on the other hand, are regulated in accordance with the properties or the weight per square meter of the web to be produced. Depending on the weight a different air permeability results, due to the density variation according to the weight. In order to insure uniformly optimal air permeability and thus a uniform web structure a variation of the air permeability must be prevented. The air currents therefore are controlled through the r.p.m. regulated drives of the compressors and fans in order to obtain minimal energy expenditure according to the density of the deposited web.

On the basis of the proposed process the production or process parameters of the different component air currents may be adjusted in accordance with their function, through the use of the r.p.m. regulated drives and the twist throttles in the compressors and fans, by regulation of the recirculated air and fresh air quantity as well as by means of heat exchangers for the recovery of the heat, such that depending on the weight per square meter an energy minimum is obtained for the drawing currents as well as the so-called holding currents. Depending on the function of the air current a greater or lesser content of suspended particles can be tolerated all the way to the complete elimination of separated products in the drawing-air currents. It has been found that, if an adjustment is made for the energy minimum of the holding currents, a substantial improvement of the web structure, that is of the uniformity of the filament deposition, is obtained, whereas if an adjustment is made for a velocity optimum of the drawing air a maximum of the filament properties (for example minimum shrinkage) is reached. An energy minimum is obtained when the conditioning currents are supplied separately.

According to the invention the high volume air currents, such as the holding current in the transport zone and the spinning room current, are supplied to the process by way of the added air distribution without expensive purfication. In this manner a substantial energy advantage results because otherwise the entire quantity would have to be expensively purified or freshly sucked in and conditioned.

The production of spunbonded fabrics through aerodynamic processes can therefore be considerably improved. Each of the different component air currents assumes a special task in the overall process. The entire spinning room therefore forms a dynamic system which, within a predetermined stability range, converges toward an equilibrium condtion by way of a sequence of system conditions. Disturbances which may arise in this connection are temperature variations of individual currents (for example outside temperature) or variations of the flow resistance of filters or sieve belts due to contamination. However through automatic regulation the equilibrium condition of the overall air balance can again be reached (compensating feedback). In the case of known spunbond production processes this has not been or has been only poorly possible inasmuch as the drawing air had to meet, as a primary air, all the different tasks. On the other hand if, the air currents required in the spinning web production are subdivided into a plurality of component currents, the energy consumption as well as the degree of purity of the component currents can be individually regulated. Each component current is adjusted, in accordance with its particular task, to a minimum, and with the aid of the separately variable spinning space current the overall air balance in the spinning space is adjusted with the optimal suction conditions in view, in such a manner that likewise optimal web structure is obtained. The suction conditions which, in cooperation with the different component currents determine the quality of the spinning web from the standpoint of filament quality as well as web structure, may be optimized in this manner.

The holding current supplied, subsequent to the laying down of the web, in the transport zone as well as the spinning room current serving for overall balancing-out has a higher proportion of suspended particles (spinning dust) than the drawing current or the conditioning current impinging directly at the drawing nozzles. However it has been found that in these locations the suspended particle proportion does not disturb any more since no filament drawing or web deposition takes place any longer. The web is merely maintained in its structure until its transfer to the bonding aggregates. The farther removed from the filament or web formation, the higher a suspended particle proportion can be tolerated. It is possible therefore to utilize recirculated air to a high degree, whereby a considerable saving in energy results.

BRIEF DESCRIPTION OF THE DRAWINGS

The invention will now be described in greater detail with reference to the accompanying drawings, wherein.

BRIEF DESCRIPTION OF THE PREFERRED EMBODIMENT

Figure 1:
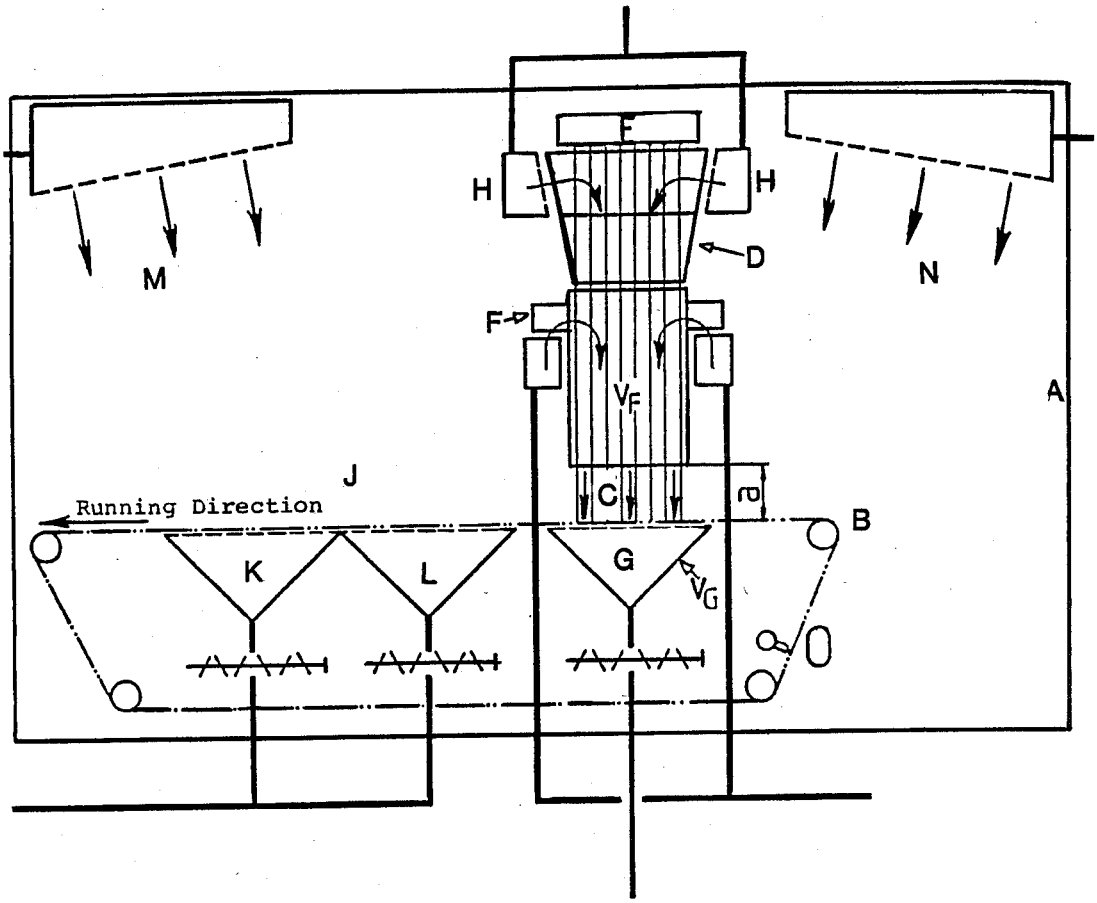
FIG. 1 shows the schematic of the different component currents in the so-called spinning room.

In FIG. 1 a cross-section through spinning room A is illustrated. The web formation takes place on the perforated collecting screen B in zone C. The filaments D emerge from the spinning nozzle E and they are vertically supplied to the web formation zone C by way of drawing channels F. In the case of a large industrial plant approximately 30 longitudinal spinning nozzles E are provided side by side which deposit the filaments on a catching belt B of approximately 4.5 m width to form a web. Each nozzle spins 600 to 1,000 filaments depending on the titre. The conditioning air currents are separately fed by the channels H. The freshly formed web is carried off through conveying zone J; underneath the conveying sieve two suction zones K and L are provided which cause the web to be held by the corresponding negative pressure—without being unduly sucked into the sieve fabric since otherwise distortions result upon transfer to the bonding aggregates. It is for this reason that suction zones K and L are provided. The negative pressure diminishes in the running direction. Also in the running direction the velocity of the traversing air is decreased by correspondingly designed perforated sheets underneath the sieve belt. To compensate for the air currents thus sucked off, the holding current is supplied at M; it is returned by recirculation. To compensate the overall system in feedback fashion the added or spinning room air current N is used which equalizes the overall air balance and preferably provides for an excess of approximately 10%. At O a fluid current is blown on for cleaning the sieve belt of suspended particles.

Figure 2:
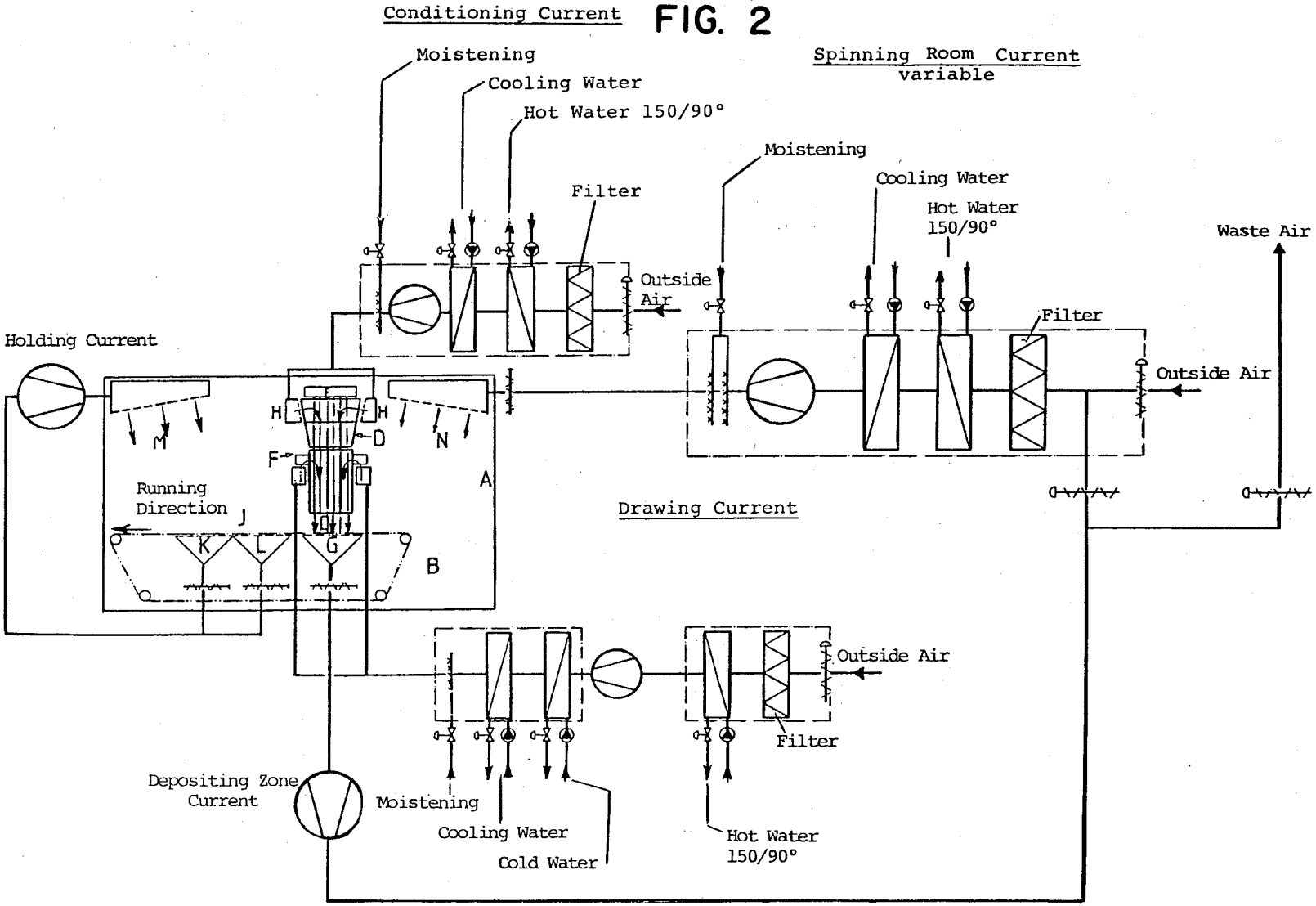
FIG. 2 shows the overall flow diagram.

FIG. 2 shows an overall air flow diagram of the spinning room as well as the different currents which serve for the supply of the spinning room and have correspondingly different functions. The pure conditioning current which preferably is supplied with outside air is sent, upon filtration, through cooling or heating aggregates and, upon corresponding moistening, is conducted into spinning space H. Cooling or heating are determined by the variable outside conditions (ambient air) and they serve to set up constant conditioning parameters. The holding current M, in particular, is conducted as a recirculating current and it has a high proportion of suspended particles. This proportion increases in the running direction of belt B because the current traversal is diminished in this direction. This is brought about by differently perforated sheets under sieve belt B. The porosity in zone L is higher than that in zone K. The drawing current is supplied from the ambient air and also is kept constant by corresponding cooling or heating and by moistening. This current is then carried back by common suction in recirculation together with the variable spinning current N whereby depending on the desired conditions, ambient air may be added to the recirculated air.

The following example shows the proposed process in the production of polypropylene spinning webs:

EXAMPLE

A spinning plant of 30 longitudinal spinning nozzles, disposed side by side, was used. Each spinning nozzle had, selectively 600 or 1,000 spinning apertures arranged in seven rows. The aperture diameter was 0.4 mm. The collecting screen had a width of 490 cm, the suction zone thereunder had the following dimensions:

| | Width | Length |
|---|---|---|
| K | 480 cm | 255 cm |
| L | 480 cm | 340 cm |
| G | 480 cm | 105 cm |

A polypropylene granulate with a melting index of 19.5 was used. The granulate was melted in an extruder and the melt was passed through a central filter at a temperature of 270° and was fed to the spinning locations. The extruder was operated with pressure regulation at a throughflow of 700 kg/h. Since, due to easily changing viscosities of the starting material the pressure of the melt normally varies, it was possible to hold the pressure of the melt automatically constant by variation of the speed of rotation. The melt fed to the spinning nozzles was extruded through the spinning apertures and the filaments were guided downward by the drawing air by means of rectangular drawing-off channels; these channels were provided with slots each of which had a free cross-section of 120 $cm^2$. The air currents used in accordance with FIG. 2 had the following parameters:

| | |
|---|---|
| Conditioning current: | $V_L$ = 25,000 $m^3/h$ |
| | $\Delta P$ = 0.04 bar |
| Holding current: | $V_L$ = 130,000 $m^3/h$ |
| | $\Delta P$ = 0.018 bar |
| Spinning space current: | $V_L$ = 200,000 $m^3/h$ |
| | $\Delta P$ = 0.012 bar |
| Drawing current: | $V_L$ = 25,000 $m^3/h$ |
| | P = 0.15 bar |
| Deposition zone current: | $V_L$ = 180,000 $m^3/h$ |
| | P = 0.04 bar |

The air velocities in the conveying zone J were graded in running direction by means of perforated sheets with a free cross-section of FO, a hole diameter W and a pitch T, which sheets were provided underneath the sieve belt:

| | FO | W | t |
|---|---|---|---|
| G | 64.7% | 3.8 mm | 4.5 mm |
| L | 51% | 3.0 mm | 4.0 mm |
| K | 36.2% | 3.8 mm | 4.75 mm |

What is claimed is:

1. A process for the production of spunbonded fabrics in a spinning room by aerodynamically drawing filaments or filament rovings with the aid of air currents divided into component currents and supplied to a perforated collecting screen where they are deposited in random texture, are held in this position by air suction and supplied to a bonding aggregate, wherein the air current is divided into a conditioning current and a drawing current for the conduction and the drawing of the filaments or filament rovings and into a deposition zone current for the fixation of the web, which has been deposited in random texture, in its transportation on the perforated collecting screen, the deposition zone current being sucked off through the collecting screen together with the spinning room air in a plurality of zones and being reintroduced into the spinning room as a holding current, and an additional spinning room current being introduced into the spinning room for balancing out the overall system, the conditioning current as well as the drawing current being introduced in solely added air mode and the depositing current and the holding current being withdrawn and introduced, respectively, in mostly recirculated mode, and wherein the spinning room current is supplied in mixed recirculated air/added air mode or in solely added air mode and the air velocities, as the filaments are being sucked off the holding zone on the collecting screen, are lowered in the running direction, whereby, by means of the aforementioned air conduction of the component currents, the concentration of suspended particles is reduced in the opposite direction.

2. A process as claimed in claim 1, wherein the drawing current, prior to introduction into the spinning space, is held free of volatile suspended particles of the spinning melt and/or oily aerosols.

3. A process as claimed in claim 2, wherein immediately adjacent to the spinning nozzle a conditioning air current is supplied that is free of volatile suspended particles or the suspended particle content of which is lower than the one of the air currents supplied in the transport zone.

4. A process as claimed in any of claims 1 to 3, wherein the sum of all the air currents supplied to the spinning space is greater than the sum of the withdrawn air currents.

5. A process as claimed in claim 4, wherein within the spinning space an excess air pressure of up to 10% is set up.

6. A process as claimed in any of claims 1, wherein the filaments are supplied to the collecting screen belt at a velocity which is 10 to 20 times higher compared with the running velocity of the web.

7. A process as claimed in any of claims 1 to 3, wherein the supply systems of the component currents are provided with control devices for air quantity, temperature and moisture and, if desired, with filter devices for the removal of suspended particles, and wherein the air currents are individually regulated and optimized, independently of each other, by means of the control devices or filter devices in accordance with the material properties of the filaments and/or the web.

8. A process as claimed in any of claims 1 to 3, wherein the spinning webs are produced from polyester, polyamide and/or polypropylene.

9. A process as claimed in any of claims 1 to 3, wherein the collecting screen prior to the web formation zone is subjected to a fluid current so as to free it of suspended particles.

* * * * *

UNITED STATES PATENT AND TRADEMARK OFFICE

CERTIFICATE OF CORRECTION

PATENT NO. : 4,578,134

DATED : Mar. 25, 1986

INVENTOR(S) : Hartmann

It is certified that error appears in the above-identified patent and that said Letters Patent are hereby corrected as shown below:

Page 1, line 2 "Hartmann" should be -- Hartmann et al. --

" ", [76] After "Hartmann" insert -- , Walter Riedmüller, both of Kaiserslautern, Fed. Rep. of Germany --; delete "Pascalstr.3,6750"

" ", [30] "Dec. 1, 1984" should be -- January 12, 1984-

" ", [56], line 2, "Hartman" should be -- Hartmann --

Col. 5, line 22, after "as" insert -- well as --

" .10, " ", delete "any of"; "claims" should be -- claim --

Signed and Sealed this

*Twenty-second* Day of *July 1986*

[SEAL]

*Attest:*

DONALD J. QUIGG

*Attesting Officer* *Commissioner of Patents and Trademarks*